US007110951B1

(12) United States Patent
Lemelson et al.

(10) Patent No.: US 7,110,951 B1
(45) Date of Patent: Sep. 19, 2006

(54) SYSTEM AND METHOD FOR ENHANCING SPEECH INTELLIGIBILITY FOR THE HEARING IMPAIRED

(76) Inventors: Jerome H. Lemelson, deceased, late of Incline Village, NV (US); by Dorothy Lemelson, legal representative, Unit 802, Suite 286 930 Tahoe Blvd., Incline Village, NV (US) 89451; Robert D. Pedersen, 7808 Gleneagle Dr., Dallas, TX (US) 75428; Tracy D. Blake, 14641 N. 49th Pl., Scottsdale, AZ (US) 85254

( * ) Notice: Subject to any disclaimer, the term of this patent is extended or adjusted under 35 U.S.C. 154(b) by 0 days.

(21) Appl. No.: 09/517,993

(22) Filed: Mar. 3, 2000

(51) Int. Cl.
*G10L 21/00* (2006.01)

(52) U.S. Cl. ..... 704/270

(58) Field of Classification Search ..... 704/226, 704/233, 270, 271; 381/94.1; 623/10
See application file for complete search history.

(56) References Cited

U.S. PATENT DOCUMENTS

| | | | | |
|---|---|---|---|---|
| 4,025,721 | A * | 5/1977 | Graupe et al. | 704/227 |
| 4,118,601 | A | 10/1978 | Yeap | 179/1 D |
| 4,461,025 | A | 7/1984 | Franklin | 381/56 |
| 4,630,304 | A | 12/1986 | Borth et al. | 381/94 |
| 4,677,677 | A | 6/1987 | Eriksson | 381/71 |
| 4,891,605 | A | 1/1990 | Tirkel | 330/279 |
| 5,550,924 | A | 8/1996 | Helf et al. | 381/94 |
| 5,581,495 | A | 12/1996 | Adkins et al. | 364/724.16 |
| 5,771,306 | A * | 6/1998 | Stork et al. | 382/100 |
| 6,192,341 | B1 * | 2/2001 | Becker et al. | 704/271 |
| 6,408,273 | B1 * | 6/2002 | Quagliaro et al. | 704/271 |
| 6,618,704 | B1 * | 9/2003 | Kanevsky et al. | 704/271 |

OTHER PUBLICATIONS

Savioja, Lauri/Rinne, Timo J./Takala, Tapio; "Simulation of Room Acoustics with a 3-D Finite Difference Mesh"; Helsinki University of Technology.

Vogel, Durk P./Schurer, Hans/Slump, Cornelis H./Herrmann, Otto E.; "On the Realization of 3-D Binaural Audio Synthesis in Real Time"; hans@nt.el.utwente.nl.

Rindel, Jens Holger; "Computer Simulation Techniques for Acoustical Design of Rooms"; *Acoustics Australia*, Sep. 1995.

Schurer, H./Slump, C. H./ Hermann, O.E.; "Digital Compensation of Nonlinear Distortion in Loudspeakers"; hans@nt.el.utwente.nl.

Naylor, Graham/Rindel, Jens Holger; "Predicting Room Acoustical Behaviour with the ODEON Computer Model"; Presented as paper 3aAA3 at the 124th ASA meeting, New Orleans, Nov. 1992.

Rindel, J.H.; "Computer Simulation Techniques for Acoustical Design of Rooms—How to Treat Reflections in Sound Field Simulation"; /ASVA 97, Tokyo, Apr. 1997, pp. 201-208.

Sankar, Ananth/Heck, Larry/Stolcke, Andreas; Acoustic Modeling for the SRI Hub-4 Partitioned Evaluation Continuous Speech Recognition System; Speech Technology and Research Laboratory SRI International.

Cohen, M./Rumelhart, D./Morgan, N./Franco, H./Abrash, V./Konig, Y.; "Combining Neural Networks and Hidden Markov Models for Continuous Speech Recognition".

(Continued)

*Primary Examiner*—Angela Armstrong
(74) *Attorney, Agent, or Firm*—Douglas W. Rudy

(57) ABSTRACT

A system and method of using a combination of audio signal modification technologies integrated with hearing capability profiles, modern computer vision, speech recognition, and expert systems for use by a hearing impaired individual to improve speech intelligibility.

18 Claims, 10 Drawing Sheets

OTHER PUBLICATIONS

Mohri, M./Riley, M./Hindle, D./Ljolje, A./Pereira, F.; "Full Expansion of Context-Dependent Networks in Large Vocabulary Speech Recognition";AT&T Labs Research; (mohri,riley,dmh,alj,pereira)@research.att.com.

Cohen, M./Franco, H./Morgan, N./Rumelhart, D./Avrash, V./Konig, Y.; "Integrating Neural Networks into Computer Speech Recognition Systems".

Abrash, Victor; "Mixture Input Transformations for Adaptation of Hybrid Connectionist Speech Recognizers" SRI International; victor@speech.sri.com.

Heck, Larry/Sankar, Ananth; "Acoustic Clustering and Adaptation for Robust Speech Recognition"; SRI International; {heck,sankar}@speech.sri.com.

Stolcke, Andreas/Shriberg,Elizabeth; "Statistical Language Modeling for Speech Disfluencies"; SRI International; stolcke@speech.sri.com, ees@speech.sri.com.

Cole, Ronald A./Burnett, Daniel/Weatherill, Vince; "An Evaluation Guide for Emergent Technologies in Automatic Speech Recognition"; Center for Spoken Lanuage Understanding, Department of Computer Science and Engineering, Oregon Graduate Institute of Science & Technology, Dec. 6, 1993.

www.cscd.nwu.edu/public/ears/assistive; "Assistive Communicative Devices"; Nov. 16, 1999.

www.cscd.nwu.edu/public/ears/perforated; "Perforated Eardrum", Nov. 3, 1999.

www.cscd.nwu.edu/public/ears/hearloss; "Hearing Loss"; Nov. 4, 1999.

www.cscd.nwu.edu/public/ears/cochlear; "Cochlear Implant: A Device to Help the Dear Hear"; Nov. 3, 1999.

www.cscd.nwu.edu/public/ears/earache; Earache and Otitis Media; Nov. 3,1999.

www.cscd.nwu.edu/public/ears/cholesteatoma; "Choleasteatoma: A Serious Ear Condition"; Nov. 3, 1999.

www.cscd.nwu.edu/public/ears/otosclerosis; "Otosclerosis"; Nov. 3, 1999.

www.cscd.nwu.edu/public/balance/perilymph; "Perilymph Fistula"; Nov. 3, 1999.

www.cscd.nwu.edu/public/balance/acoustic; "Acoustic Neuroma"; Nov. 3, 1999.

www.cscd.nwu.edu/public/ears/noise; "Noise, Ears, and Hearing Protection"; Nov. 3, 1999.

www.cscd.nwu.edu/public/ears/menieres/index; Meniere's Disease; Nov. 3, 1999.

www.cscd.nwu.edu/public/blanace/test; "Testing for Vestibular Disorders"; Nov. 3, 1999.

www.utdallas.edu/~thib/rehabinfo/tohl; "Types of Hearing Loss"; Jun. 29, 1999.

www.eos.ncsu.edu/bae/research/bla...projects/1998/asstdevice_98/hearing; "Communications Aids"; Nov. 16, 1999.

www.ama-assn.org/sci-pubs/sci-news/1998; "More Than 7 Million American Children Have Hearing Loss"; *Science News Update*, Week of Apr. 8, 1998.

www.neuro.new.edu/programs/vestib/edu/hearing/cent_hearing; "Central Hearing Loss"; Nov. 3, 1999.

http://headwize.com/tech/anr_tech; "Active Noise Reduction Headphone Systems"; *HeadWize Technical Papers*; Nov. 22, 1999.

www.askmar.com/askmar/Noise/Noise%20Effects/Noise; Suter, Alice H.; "Noise and Its Effects";Administrative Conference of the United States; Nov. 1991; Nov. 16, 1999.

www.compsoc.man.ac.uk/~maniac/resource_web/harmony_central/eq: Harmony Central Effects Explained: Equalization; Jul. 19, 1999.

www.cs.tut.fi/~ypsilon/80545/RoomAccoustics; "Room Accoustics"; Sep. 28, 1999.

www.docshop.com/info/hearingloss; Lovering, Larry J.; "Hearing Loss: The Neglected Disorder", Jul. 15, 1999.

ww.boystown.org/feafgene.reg/fundamen; "Fundamentals of Hearing Part 1", Jul. 19, 1999.

www.audiologyawareness.com/hhelp/audiogrm; "How Do We Read and Audiogram"; The Audiology Awareness Campaign; Jul. 19, 1999.

http://audiorevolution.com/equip/theatermaster/index; "Enlightened Audio Designs Theater Master"; Jan. 5, 2000.

www.mvblind.uni-linz.ac.at/myb/research/voice/deliv; "The Voice Project", Jun. 28, 1999.

* cited by examiner

SYSTEM AND METHOD FOR ENHANCING SPEECH INTELLIGIBILITY FOR THE HEARING IMPAIRED

BACKGROUND OF THE INVENTION

This invention relates to a system for enhancing the hearing ability of hearing impaired persons. More particularly, this invention pertains to the improvement of speech intelligibility for persons listening to equipment producing audio signals such as television receivers, recorded music, or radio units.

Hearing improvement aids have been under continuous development for many years. Recently, significant advances have resulted from the introduction of electronic components, electronic circuits and software developments. In the last few years, significant research has lead to a better understanding of the physiological and neurological mechanisms relating to the sense of hearing. Such research is directed to the causes of hearing impairments and possible solutions. Many types of hearing impairments can be treated with surgery or medication. For example, chronic ear infections, which can decrease hearing acuity, may be treated with antibiotics. Also, damaged eardrums can be repaired by surgery. Other ailments such as presbycusis (age related hearing loss) are ameliorated to a certain degree with hearing assistance equipment such as hearing aids.

Hearing impairment falls into four main categories: conduction loss, sensorineural loss, mixed loss, and central loss. Conduction loss is associated with problems in the outer and middle ear that prevent sounds from reaching the inner ear where they are converted from mechanical energy to electrical signals. Sensorineural loss involves either the inner ear or the auditory nerve. The inner ear contains thousands of sensory cells (haircells) that transform sounds into proper neural format to be transmitted to the brain via the auditory nerve. Problems with the sensory cells or auditory nerve exhibit the same results when hearing tests are performed. Mixed loss is a term used to represent a hearing impairment that involves both conduction and sensorineural loss. Central loss occurs when the hearing loss is not associated with conduction or sensorineural types of problems, but the brain itself has difficulty interpreting the signals received from the hearing process.

The invention presented here addresses three areas that represent significant problems for people who suffer from hearing impairments: background noise, room acoustics, and situations where the subject has lost virtually all of his or her hearing capabilities.

It is well known that background noise presents a problem for persons with normal hearing and even more severe problems to many people with impaired hearing. Background noise addressed by this invention falls into three categories. First, system or electrical circuitry background noise is inherent in all electrical equipment. Such system background noise has many sources including induction from ambient electromagnetic sources and non-linear circuitry introducing distortions into the desired electrical signal. Background system noise, if not mitigated, is mixed with the desired audio signals and is reproduced by the speaker system. A second type of background noise is the ambient noise created by machinery, other people, and other sounds that exist in the immediate environment of a person trying to discern spoken words. Ambient background noise has many sources such as crowded rooms (many people talking), air conditioners and fans, kitchen equipment, traffic and road noise, the hum of facsimile machines and computers, factory/industrial equipment, etc. A third type of background noise is defined as those components of an electronic audio signal that interfere with a hearing impaired persons ability to understand the speech component of the same signal. For example, a hearing impaired person watching a television program that has a person speaking and a siren in the background may have trouble resolving the speech. This interfering background noise differs from ambient background noise in that it is part of the sound being produced by the speaker system. Multiple speakers talking at the same time on an audio program presents such interfering background noise problems.

Several concepts and systems for the reduction of background noise exist. For instance, see U.S. Pat. Nos. 4,025,721; 4,461,025; 4,630,304; and 5,550,924, each of which is incorporated herein by reference.

The second environmental condition that causes hearing difficulties is related to room or environment acoustics. Techniques for improving audio quality for particular types of hearing impairments are of marginal value if audio speakers are in an environment having poor acoustics. Poor acoustical environment, whether in a private home, a car, a shopping mall, or sometimes even an auditorium, can make listening to a television, recorded materials, radio or a live performance, difficult even for a person with normal hearing. Sound waves emanating from speakers will contact every surface in the environment and the uncontrolled reflected, and to some extent the absorbed, sound waves will have an effect on the overall sound quality in the environment. The interaction of sound reflections with the incident sound waves can produce room resonance, resonance at natural frequencies, and standing waves. Research into minimizing these sound wave interference effects has resulted in speaker placement concepts and software techniques for acoustical design of enclosures, interior spaces and rooms in general. Signal processing techniques, wherein a digital audio signal is conditioned through software before being output to the speakers, have also been developed.

Even with the use of hearing improvement techniques such as environmental tuning to improve acoustics and control techniques to account for background noise, there still are situations where hearing impairment remains. For extreme cases of hearing loss, including total hearing loss, other methods have been developed. In one approach, the speech in an audio signal is isolated with sophisticated mathematical processing techniques. After the desired components of a particular audio signal are isolated, they can be analyzed and synthesized into textual equivalents of the original target speech sound. The speech, synthesized using a software program is then displayed as the text on a television screen or other display device. Speaker independent speech recognition is one technique to determine spoken words present any audio signal from a television, prerecorded playback device, live presentation, radio, or other source containing spoken words. Speech recognition algorithms process digital audio signals derived from an analog signal or inherently present in digital signals such as those used for digital television or audio broadcasts. Complicated signal processing algorithms, such as hidden Markov modeling (HMM), are implemented to resolve the speech in the presence of other speakers or other types of background noise. Once a speech signal is isolated it can be displayed as sub-titling or amplified to stand out from the other sounds in the audio signal.

Another sophisticated technique for the translation or conditioning of speech so that the actual speech can be textually or graphically presented is found in lip reading systems. The lip reading of a video signal incorporates established techniques used in computer vision. Mathematical or digital modeling of the face and lips of a speaker, singer, or the like, projecting words make computer vision lip reading a viable technique to translate or condition speech elements transmitted through a video signal.

Another element that is background to this invention is the evolution of expert systems. Expert systems are well known in the research community and are implemented in diverse systems today. An expert system is a problem solving technique and methodology that takes advantage of the knowledge base of experienced professionals and technicians who have many years of training and experience in a particular field. For example, in the medical field, expert systems use the knowledge of many experienced doctors to assist in the diagnoses of disease. Expert experience and knowledge is input into a cumulative database. The database can be searched by other doctors, technicians and interested parties to assist in the diagnoses of medical conditions based on particular patient symptoms. Expert systems use a forward or backward chaining process to answer posed questions. Facts input from a user become part of the database to be used in the chaining process. In a typical query, a doctor inputs the patient's current and/or past symptoms. Those symptoms are "facts" that aid the expert system in answering queries concerning the type of malady.

While systems and methods exist for improving hearing ability of the hearing impaired, for filtering background noise, and for compensating for room acoustics, a comprehensive integrated system and method using a combination of such technologies integrated with individual hearing loss profiles, modern computer vision, speech recognition, and expert systems all operated under the control of the hearing impaired individuals to improve speech intelligibility has not heretofore been described. Thus a need exists to provide such a comprehensive system and method to improve speech intelligibility for the hearing impaired.

SUMMARY OF THE INVENTION

This invention relates to a method and apparatus for assisting hearing impaired people in discerning, recognizing, understanding, and resolving speech transmissions emanating from a television, a prerecorded playback device, a radio, and other audio sources either over background noise, or in an acoustically challenging environment, or in situations where the listener is severely hearing impaired. The system is configurable to help different people tune the system to their individual requirements. The system and method of the present invention integrates multiple signal processing circuits/algorithms, hearing test results, and individual control operations to provide comprehensive audio speech intelligibility enhancements for specific hearing impairments. The integrated approach herein disclosed compensates for individual hearing losses in particular acoustical environments, altering individual frequency components of the transmitted audio signal to compensate for room acoustics.

For the severely impaired or completely deaf listeners, the system and methods of the present invention also implement speech recognition and lip reading algorithms for determination of spoken language. Lip reading is especially useful when the audio program or situation involves several simultaneous speakers, or a speaker talking in the presence of other background noise. The system user may identify the particular speaker to be listened to using a technique such the well-known mouse or screen pointer. The computer vision system can then focus on that particular person in the video program for lip reading to provide or enhance speech recognition. The computer vision and electronic translation of the audio and video inputs may be displayed as text on a visual display device or audible speech may be generated through speech synthesis.

The present invention incorporates adaptive filtering techniques to provide for minimization of the three types of background noise: system noise, interfering noise, and ambient noise. Adaptive filtering is a well established technique for mitigating system noise. With no input signal applied to the system, there will be some noise existing due to the nature of imperfect electronic systems. The adaptive system modifies filter coefficients until the output of the system is zero with no input present. When the audio signal is applied at the input, the system noise reduction filtering functions to maintain the minimization of the system background noise.

Further filtering of interfering background noise from an audio signal provides for enhanced speech intelligibility for many hearing impaired persons. If the noise present in an audio signal is near stationary, that noise can be isolated using an adaptive filter. Adaptive filtering based on the well established finite impulse response (FIR) filtering and the infinite impulse response (IIR) filtering methodologies is effective in reducing such noise. Such adaptive filtering techniques use FIR or IIR filters wherein coefficients can be modified using various adjustment algorithms including, for example, the least mean squares (LMS), and recursive least square (RLS) methods.

Adaptive filtering is also incorporated in the present invention for minimizing the harmful effects of ambient background noise. Ambient noise includes those sounds that exist in a particular listening environment from any other source other the desired audio source. Examples of such ambient noise sources include mechanical devices (fans, automobiles, etc.), other people in the room speaking or making other noises, a radio playing in a nearby location, etc. An effective technique is the use of headphones with an adaptive filter implemented to introduce "anti-noise" to cancel ambient background noise.

The present invention also incorporates a feedback technique for adjustment (equalizing) of environment, space or room acoustics. Room acoustics issues are very important when attempting to provide an environment for quality audio listening. When sound from a speaker reflects off the walls or other objects, the sound quality is degraded due to the interactions of the reflected waves with the incident waves. In this invention, room acoustics are addressed, for example, by tuning the output from the transmitting receiver to the speakers located in the room in accordance with empirical data resulting from a test session. This is accomplished through the generation of a pink noise signal from the speakers and measurement of the room acoustical response. Individual frequency band amplitudes are adjusted until the response at a particular listening location is acoustically flat. A flat response implies that the level at the listening frequencies is identical, the ideal situation for a person with normal hearing.

However, attainment of a flat response is not the ideal solution for a hearing impaired listener having reduced hearing sensitivity at some frequencies. To accomplish the desired quality of audio perception for a hearing impaired listener, the present invention incorporates a frequency compensation system. An input to this compensation system is information describing a listeners hearing response capability. That information is used to modify the sound wave levels at a listener's location to compensate for the listeners hearing deficiency. The frequency hearing profile for a particular hearing impaired person is provided as input information to the equalization portion of the disclosed system and method.

A data input system comprised of a keypad, keyboard, remote control, or other input device allows a user to input the information about the listener's hearing response. The listener's hearing response information may be obtained from an audiologist who has performed a hearing test on the listener. The results of the test are displayed on an audiogram. The results of the audiogram may be stored on transportable digital storage media. This test result may be taken to the home of the listener or other listening location and used in the adjustment of the speech, music or other sound generating system, as well as the placement of speakers, in the listening area. The audiogram results are loaded into the system for use in compensation of the hearing impairment. The system may also have a modem or other data communication system connection via a local telephone system, or other communication link, allowing data from an audiologist's office to be sent directly to the proposed speech enhancement system in the listener's home, office, car, or other environment.

The present invention also incorporates capability to administer a hearing test similar to the one performed by an audiologist. If a person does not know their hearing response or has not been tested in a long period of time, he or she may execute the system hearing test function. The user actuates the test through controls on the system unit or by a remote control device that may be used to interface with the system unit. The system provides either audio (synthetic speech) or visual (TV screen, personal digital assistance, digital camera or the like, for instance) instructions describing how the test is performed. Audible tones of specific frequencies are introduced to speakers in the listener's listening location. The amplitude of the audible tones is reduced in stages until the listener can no longer hear the individual tones. The listener will, at that point, provide an indication to the hearing test system indicating that he or she cannot hear a tone. The test sequence continues until an appropriate range of audible frequencies has been presented to the listener. The results of the test are saved with a unique file identification identifying the associated person. The saved results are used whenever a particular listener wants to use the system. He or she will install the saved data into the system and the system will make the necessary audio corrections to the sound output signals to accommodate the particular listener hearing profile.

For severely impaired or totally deaf persons, speech recognition techniques allow for speech from an electronic device to be resolved and displayed. The proposed system uses speaker independent speech recognition algorithms to allow identification and display of the speech. The disadvantage of present closed captioning is that it must be accomplished for each individual program in advance of a broadcast. In the method of this invention, the captioning system runs in real time, or near real time, and does not have to be prepared prior to broadcast of the particular show or program. The speech recognition function can also be used for audio programs other than television audio including, for example, the playing of prerecorded music, "live" performances of many types, as well as normal conversation. The "translated" output from the audio source is directed to a TV monitor, personal digital assistant, digital camera, or other device for displaying the "translated" speech as processed by appropriate speech recognition programs and algorithms.

The present invention also employs an electronic remote control device for several system operational functions including basic system operation, data entry, and audio feedback. The remote unit is used as it is with many other types of electronic equipment. Basic control such as on/off is provided from the remote unit. Information from an offsite or on-site hearing test can be entered through a remote control. Settings can be made in much the same way employed to program a clock or video/audio features on almost all TV's and VCR's today.

When performing equalization, that is the optimization of the audio sound levels from an audio device to accommodate a particular listener's hearing impairment situation, feedback from the listener's position is used to compare output levels to levels at the listeners position. This feedback function is incorporated into the remote control. The remote control incorporates a microphone and a transmitter and either transmits analog information or has the capability to digitize the analog signal for digital communication. Many remote functions for electronic devices, such as TV's and VCR's, use standard encoding, making it possible to design a single remote control with integrated control for TV's, VCR's, DVD's, receivers, among other products, and the speech enhancement system apparatus herein described.

The present invention incorporates a computer vision method of lip reading as a second means of speech recognition for determining the spoken words of a live performance or from a video display with persons talking, signing and the like. Lip reading requires no audio input, using instead lip position and facial expressions to determine spoken words. The lip reading function is used in conjunction with the speech recognition function to improve overall performance of the system. In addition to using computer vision to read lips and facial expressions, computer vision can be used to read American Sign Language or other forms of physical signs and motions to express the words and emotions of the "speaker."

An expert system is employed in the disclosed invention for increasing the functionality and accuracy of the speech recognition process. Speaker independent speech recognition algorithms are not exact or particularly accurate especially when used in the presence of multiple speakers or other background noise. The present invention incorporates an expert system for detecting and filling in words which were inaccurately determined by the speech recognition and/or computer vision algorithms. For instance, a speaker may have said "the horse is brown" and the speech recognition system detects the phrase as "the horse is round." The expert system, knowing the previous words spoken and the context of the conversation, soliloquy, or learned speaking patterns determines that a better choice for the word "round" would be "brown." Experts in linguistics and natural language train the expert system for a proper knowledge of what word or phrase is correct for a given contextual situation.

It is therefore a principle object of this invention to improve speech intelligibility for hearing impaired persons by digitally processing audio signals produced by electronic devices such as television, pre-recorded media, or radio.

It is another object of this invention to improve speech intelligibility for hearing impaired persons by digitally processing speech in "live" performances.

It is another object of this invention to use adaptive filtering techniques to reduce background (system, interfering, and ambient) noise to improve speech intelligibility for the hearing impaired or others in an acoustically challenging environment.

It is another object of this invention to isolate the noise from a speech plus noise audio signal using adaptive techniques and subtract the noise portion from the original signal and thus reduce background noise.

It is another object of this invention to adjust the transmitted audio output to accommodate unique environment or room acoustic situations to improve listening quality for hearing impaired as well as for non-impaired persons.

It is another object of this invention to use feedback, including listener interpretive, qualitative feedback from a listener or a listener's position for equalization of a transmitted audio signal.

It is another object of this invention to allow input to the hearing enhancement system of professionally administered hearing test results for use in equalization.

It is another object of this invention to make use of a standard method of saving hearing test results on storage media such as electronic storage media. The stored results may be transported to speech enhancement system and inserted into the speech enhancement system for downloading to the system control unit.

It is another object of this invention to perform a hearing test to determine the hearing response for different persons and provide a system that can save and recall the results of such hearing tests for different individuals.

It is another object of the invention to use the results of the hearing test for equalization of a particular hearing-impaired person.

It is another object of this invention to perform speech recognition on audio signals that include speech.

It is another object of this invention to display words determined from speech recognition algorithms on a television screen or other graphic display device.

It is another object of this invention to use lip reading algorithms for determination of spoken words in a live performance or in a displayed video.

It is another object of this invention to provide an apparatus, technique, or method of selectively enhancing, while optionally eliminating, a particular component of an audio signal.

One of the objects of this invention is to provide a method of improving the quality of life of a hearing impaired person and others in the immediate vicinity of the hearing impaired person. This can be accomplished by performing certain acts of enhancing the speech component of an audio presentation for the benefit of a hearing impaired person by compensation of the speech component of the audio presentation. The desired effect is to yield a compensated audio presentation that does not require a significant increase in the dB level of the audio presentation. This may allow the hearing impaired person to perceive virtually all of the audible frequencies in the audio presentation without having to turn up the loudspeaker volume to an obnoxious dB level.

The preferred embodiment of the invention is described in the following Detailed Description of the Invention and attached Figures. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for" or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

BRIEF DESCRIPTION OF THE DRAWINGS

The invention will be readily understood through a careful reading of the specification in cooperation with a perusal of the attached drawings wherein.

DETAILED DESCRIPTION OF THE DRAWINGS

Television programs, live performances, the playback of prerecorded audio or video performances, radio presentations, and other audio presentation situations that generate spoken words having both speech and interfering background noise present an obstacle for hearing impaired persons in resolving the speech. Background noise in these situations refers to sounds other than speech existing in an audio signal. Examples of this type of interfering background noise include electrical interference, machine sounds (airplane, automobile, factory, etc.), music, weather sounds (wind, rain, storms, etc.), cheering/clapping from a crowd, and many other similar natural or artificial noise situations. The present invention ameliorates such background noise while also compensating for room acoustics and particular hearing impairments of individual system users.

Figure 1:
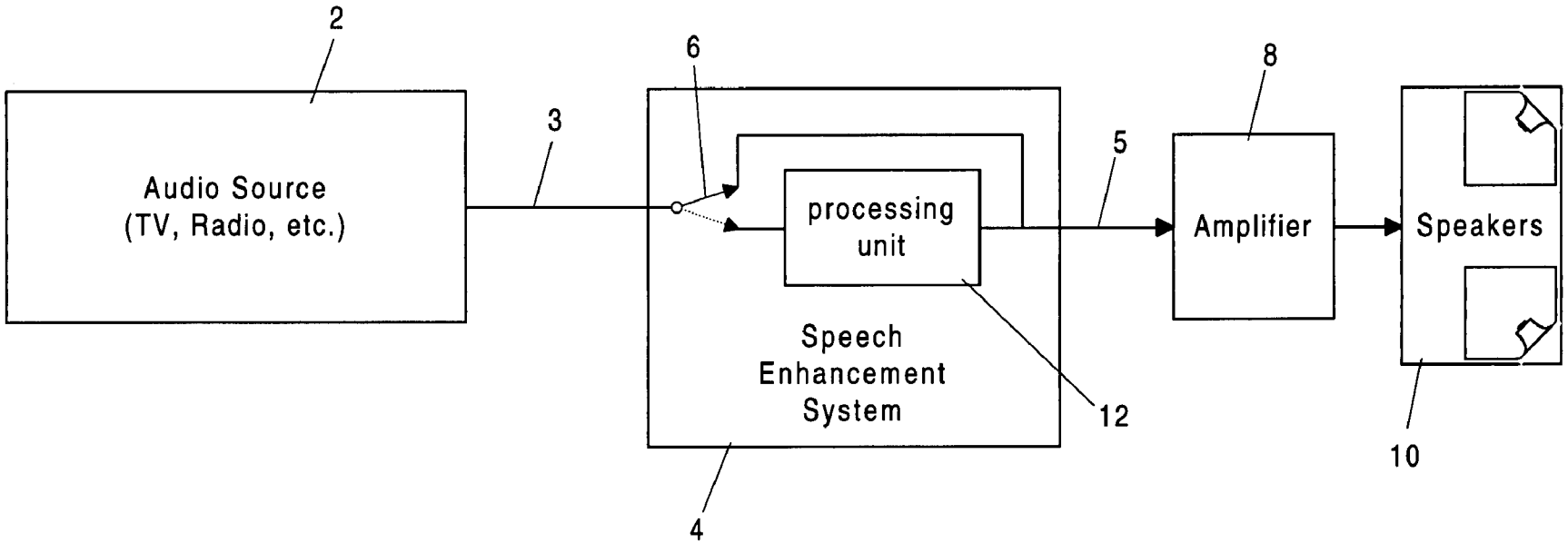
FIG. 1 is a block diagram of an audio system incorporating the proposed speech enhancement system.

FIG. 1 depicts a typical arrangement for the proposed system connected to an audio source containing speech and noise. The audio source 2 may be a television, radio, or any other source of an audio signal containing speech that may contain background noise interfering with a hearing impaired person's ability to resolve the speech. It may also be a live performance situation; however, for this disclosure the preferred embodiment will be directed to a typical broadcast (or prerecorded media) situation, it being understood that a live performance situation can also benefit from this invention. The output of the audio source is connected to the disclosed speech enhancement system 4 using a signal carrying wire, cable or conduit 3, or in other embodiments by using infrared, microwave, fiber optic or other signal carriers. The speech enhancement system 4 is a stand-alone electronic component as shown in FIG. 1, or alternatively the speech enhancement system 4 may be a module built into a television set, receiver, pre-recorded material playback unit or the like. As the speech enhancement system is primarily an electronic device it is anticipated that it could be packaged on one or more integrated circuit chip(s) or circuit board(s), or a combination of both. Being such a small device it could easily be included in an audio receiver, a personal digital assistant, a cell phone or the like, or a digital recording device.

A selector switch 6 within the speech enhancement system 4 allows the speech enhancement system or circuitry to be bypassed when the speech enhancement unit 4 is not being used. The speech enhancement system 4 output is supplied to an audio amplifier 8 through connection 5, such that the amplifier supplies the necessary power to drive, through hardwire or other transmission media 9, the speaker system 10, headphones, or the like. When the speech enhancement system 4 is turned off, the selector switch 6 directs the output of the audio source 2 directly to the amplifier 8 as is depicted in FIG. 1.

Figure 2:
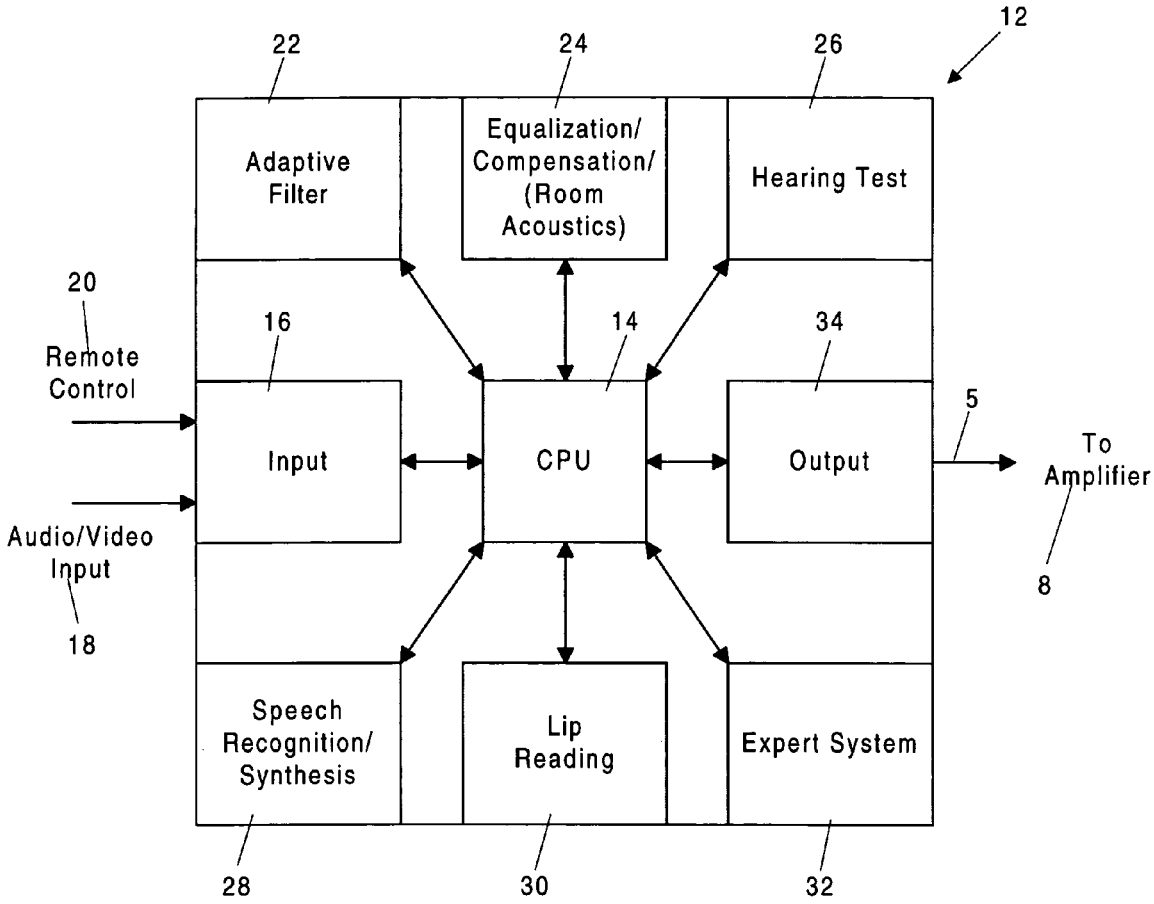
FIG. 2 is a block diagram showing the components of the speech enhancement system.

The block diagram of FIG. 2 identifies components of the speech enhancement system 4, and in particular the elements of the processing unit element 12 shown in FIG. 1. A central processing unit (CPU) 14 coordinates individual functions of the system and handles system level tasks required for proper operation of the speech enhancement system. Although only one CPU 14 is shown, other dedicated microprocessors, or processing elements emulating the functions of a microprocessor, may be used to implement some of the individual functions.

Audio/video signals 18 and remote control signals 20 are connected via input port connection 16 to the system for analog signal conditioning and conversion to digital data via an analog-to-digital (A/D) converter. A conventional and well known A/D converter is not shown but is included in the input port connection 16. The output section 34 of the speech enhancement system 4 converts the processed digital information back to analog with a digital-to-analog converter (D/A), not shown but conventional and in a preferred embodiment a part of the output port connection 34. The output port connection will condition the analog signal for output to the audio amplifier 8. Signal propagation is accomplished through any type of signal transmission media such as wire, cable, laser, infrared, optical fiber, microwave, or the like as represented by connection 5.

The adaptive filter section 22 of the speech enhancement system of FIG. 2 provides a circuit and a methodology of reducing background noise to improve intelligibility of the speech. Multiple filtering hardware units whose outputs are summed together (digital or analog summation) may be used or just one with sufficient processing power for all filters may be employed. The adaptive filter automatically adjusts its response (i.e. digital filter coefficients) to mitigate system background noise, ambient background noise, and near stationary interfering background noise in audio signals.

System background noise is reduced by configuring the adaptive filter(s) to modify filter coefficients with zero input level. With the input at zero, any audible noise in the system is unwanted and should be eliminated. After adaptation this background system noise is subtracted from the main audio signal during normal operation of the audio system.

Near stationary interfering background noise (automobiles, machinery, wind, etc.) is also mitigated with another adaptive filter. Breaks between spoken words are always present allowing the filter to adapt its response during the gaps. Adaptive filtering algorithms can remember past samples of the information found between the breaks in words and use them with the current samples to formulate a strategy for minimizing the background noise.

Another adaptive filtering channel can be used in conjunction with headphones to minimize ambient background noise. Microphones located near the headphones and inside the ear cups provide feedback to the adaptive algorithm. The ambient background noise reduction algorithm is run with no signals applied except those picked-up by the microphones. The external microphone picks up the ambient noise that is then processed by the adaptive filter to create "anti-noise" that is reproduced by the speakers in the headphone cups. When the anti-noise is at the desired amplitude and phase relationship it cancels the ambient noise. When the noise inside the headphone cups is attenuated, the adaptive process is halted and the regular audio signal (or the desired audio signal, which may not necessarily be speech) is applied to the headphones.

Any enclosed listening area presents audio problems dependent on its acoustical properties. Room acoustics almost always have a negative effect on the quality of sound produced by audio speakers. The equalization or compensation circuit 24 of FIG. 2 provides for adjustment of the sound output from the speakers 10 (FIG. 1) to improve speech intelligibility for a person with normal hearing or for a hearing impaired person in an acoustically challenging environment. The interactions of reflected sound waves from speakers has attenuating and amplifying effects on the sound level at a particular listening location. Using feedback from the listeners' location, the speech enhancement system automatically equalizes the sound levels for the frequencies of interest to compensate for the acoustic properties of the listening environment. The goal of the equalization is to yield a flat response for the audio frequencies of interest, normally the band from 20 Hz to 20 kHz. In practice, such equalization provides for improved sound quality even though it is difficult to perfectly equalize across the entire audio spectrum.

The integrated compensation/equalization method of the present invention permits simultaneous equalization for the room acoustics and compensation for particular hearing impairments of individuals using the system. That is to say, for a hearing impaired person the equalization/compensation function 24 allows individual frequencies to be adjusted that pose a problem for the hearing impaired person. This compensation/equalization process adjusts the level at particular frequencies not just for room acoustics but also the deficiency of a hearing impaired person. For example, a person suffering from presbycusis (age related hearing loss) may experience a 30 dB hearing loss at a frequency of 4 kHz. Amplifying of the audio signal response at 4 kHz by 30 dB compensates for the hearing impairment at this frequency. If a person's hearing response is known, each of the frequencies of reduced sensitivity can be compensated, allowing for the improved recognition of spoken words that was degraded by the hearing impairment. Equalization for room acoustical anomalies then proceeds with the modified frequency response designed for those particular hearing impairments.

The speech enhancement system 4 also has the capability of providing for the administration of a hearing test via the hearing test unit 26 of FIG. 2. The hearing test can be easily conducted in a self-directed manner directed by the listener. Audible tones are first broadcast from the speakers in the local environment or via headphones worn by the user. The volume of the audible tones is reduced until the test subject can no longer hear the tones. This is the same type test given by professional audiologists. The equalization for room acoustics (for flat response) is performed first to prevent skewed results on the hearing test. Using headphones provides for a more controlled listening environment. The results of the hearing test are saved in an electronically retrievable storage media or the like. Encoded data results from the hearing test can then be retrieved and subsequently used in the equalization process.

Speech recognition module 28 and lip reading module 30 (for use with video or live performances recorded with a camera) provide the capability to recognize speech and display the spoken words on a visual display such as a television screen or other display unit. This capability permits the severely impaired or completely deaf person to view the video transmission of a televised presentation and be presented with the content of the spoken, sung or other audio portion of the presentation. Speech synthesis can be used in combination with the speech recognition and lip reading capabilities to generate audible spoken words.

Existing speech recognition and lip reading programs, software and algorithms are not one hundred percent accurate. The present invention implements an expert system 32 to assist in correcting the misinterpretation of recognized phrases that have been improperly translated by the speech recognition or lip reading programs. The expert system 32 is programmed to provide context dependent speech recognition through the substitution of more likely more probable words in phrases or sentences based on context and/or learned or taught speaking patterns. For example, sporting events have particular words or phrases that are repeated frequently such as "score," "ball," "bat," "player," "number," "at bat," etc. The expert system 32 is programmed to replace misrecognized words with the more probable context and program dependent words or phrases.

Figure 3:
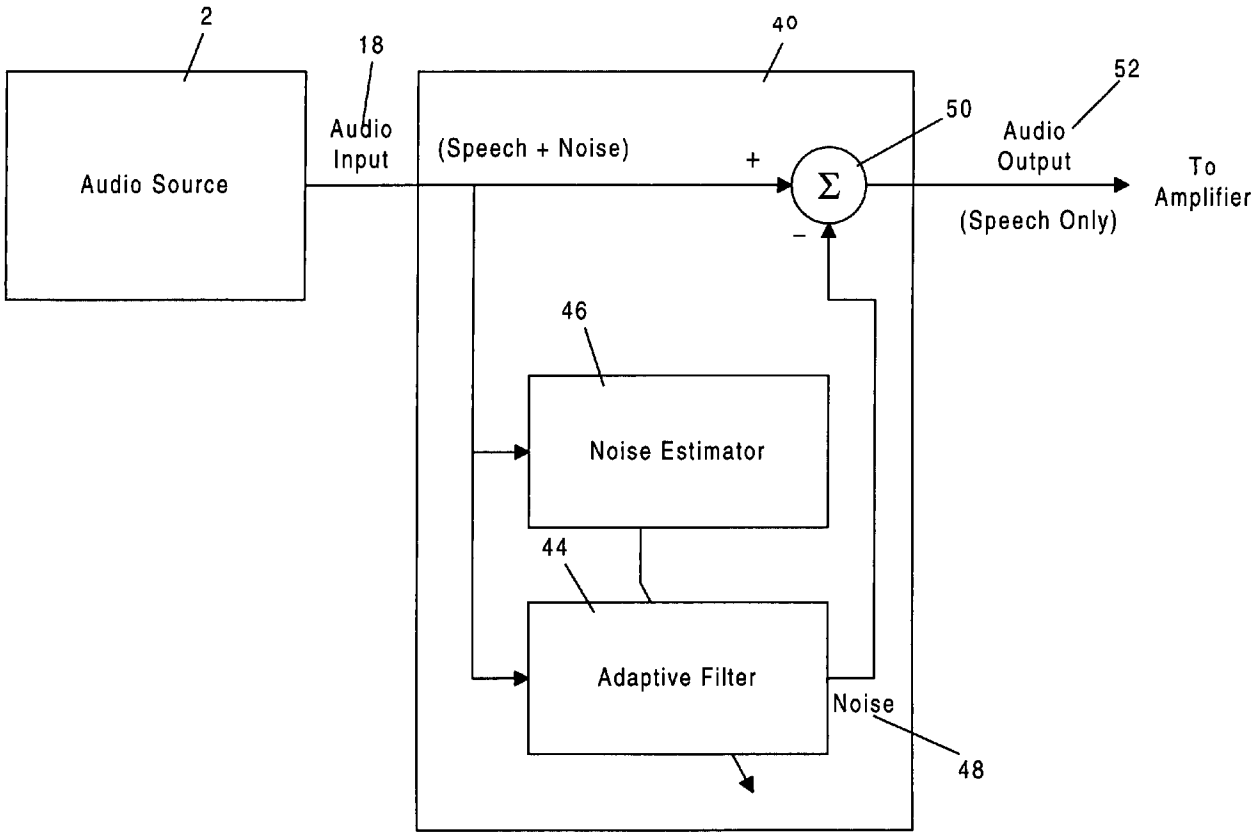
FIG. 3 is a block diagram of the adaptive filtering function of the speech enhancement system used for background noise rejection.

FIG. 3 is a block diagram of an interfering noise reduction apparatus and method 40. The audio source 2 represents an electronic device that processes audio signals whose input contains both speech and background noise 18. An example of this type of signal is the audio portion of a broadcast television signal. This audio input is also introduced into adaptive filter 44 and noise estimator 46. The adaptive filter is a finite impulse response (FIR) filter or an infinite impulse response (IIR) filter. FIR and IIR filters are well understood by persons knowledgeable in the field of digital filtering. The readily available Motorola DSP56002 is an example of a single integrated circuit that implements FIR filtering. The adaptive filter coefficients are modified to provide an impulse response that can separate the noise from audio input 18 (containing both speech and interfering noise). Algorithms, such as the least mean square (LMS), provide methods for changing the filter coefficients in an orderly fashion to allow for convergence of the adaptation process. For a given type (frequency) of input noise the filter automatically adapts its response to generate a signal that is composed of the noise only 48. This noise signal is subtracted from the speech and noise input at the summing node 50 leaving only the speech 52 (or other desired audio element) for output to the audio amplifier. Single or multiple filter configurations may be used to remove interfering noise.

The noise estimator 46 provides for determination of the noise content of the initial signal entering the noise cancellation apparatus 40. Many techniques exist for determination of the "noise" content of a signal. Most approaches find periodic components in the total (speech and noise) signal. These components can exist for various periods of time with longer duration noise being the easiest to determine. Speech, in general, is not periodic so is not removed by the filtering process. For example, if in a television scene a person is talking and a car drives by, the "interfering noise" produced by the sound of the car can reduce the intelligibility of the speech to a hearing impaired person. The noise estimator 46 will detect frequency components of the car sound and adapt the filter coefficients to produce bandpass filters at those detected frequencies representing the car sounds. The output of the bandpass filters can then be subtracted from the input reducing the intensity of the passing automobile sound in the output signal.

The configuration of FIG. 3 is also used to reduce system background noise. Another adaptive filter provides an inverted signal representing the electrical noise in the system with no audio input. This filter adapts its response whenever the power is turned on before the audio signal is applied to the system. The system inhibits the input signal until the adaptation is complete. Inhibiting the audio input insures that the filter adapts to only pass the system noise and not components of the desired signal. Once the filter converges, the adaptation process is halted, fixing the filter coefficients to provide noise reduction even when the audio input is applied to the system. If system noise is detected after the system has been is use for a period of time, the user can reset the system background noise reduction filter by cycling the power off and back on again. As an alternative, the present system may have a remote control function that allows the listener to implement adaptation of the filter characteristics for minimizing the system background noise.

Figure 8:
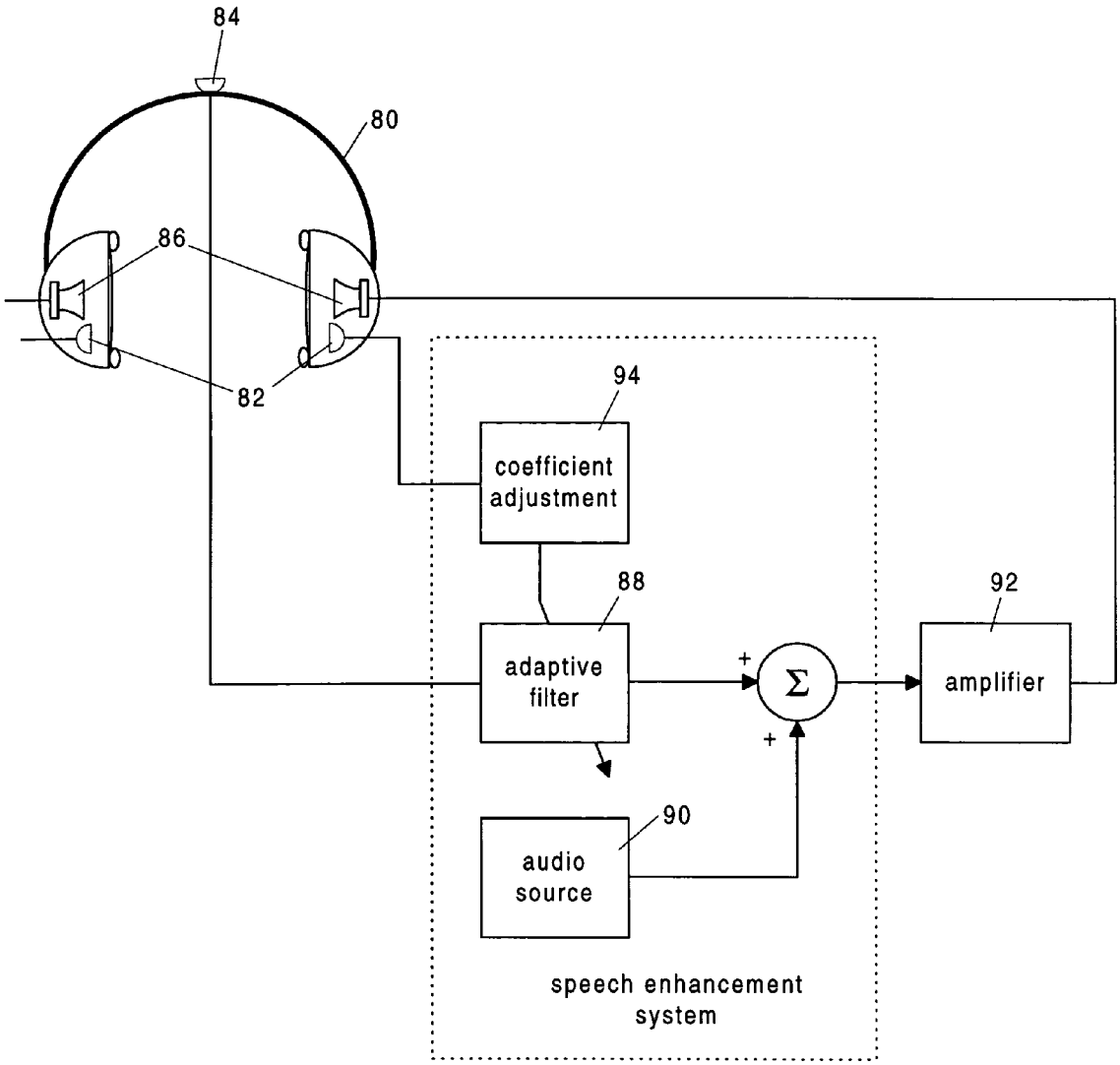
FIG. 8 is a block diagram showing the use of adaptive filtering and headphones to minimize the effects of ambient background noise.

If ambient background noise, such as air conditioning fan noise, is a problem for a listener (normal or hearing impaired) another adaptive filter used in conjunction with headphones can be used to reduce the effects of the interference. FIG. 8 demonstrates implementation of this ambient noise reduction. Special headphones 80 are worn by the listener and connected the speech enhancement system. The headphones have microphones 82 in each ear piece and another microphone 84 located midway between the ear pieces. These microphones are connected to the speech enhancement system via the same cable delivering the audio signals to the speakers 86 in the headphones.

The external microphone 84 on the headband supplies a signal to the adaptive filter 88, the response (transfer function) of which is initially set to model the headphone system. The output of the adaptive filter is inverted and summed with the signal from the audio source 90. This combined signal is fed to the audio amplifier 92 and supplied to the headphone speakers 86. The microphones 82 inside the earpieces provide feedback to the coefficient adjustment algorithm 94 (LMS, RLS, etc.) for fine-tuning of the filter. The signal from these microphones is an error signal that is used in the coefficient adjustment process to improve reduction of ambient noise.

Another problem that contributes to unintelligible speech for a hearing impaired person, or a person having normal hearing, are environmental acoustic situations. Whenever audio signals are produced in a room with fixed walls, the acoustical characteristics of the room become important. These acoustic characteristics will effect the quality of the signal at any given point in the room. Reflections of the audio source off of walls, floor, ceiling and room contents produce resonances, natural frequency interference, and standing waves that can degrade the signal intelligibility. Signal processing algorithms existing today can mitigate these effects to varying degrees. Speaker placement can also improve the quality of the audio signals for different listening locations.

Existing systems for improving audio reception and perception for the hearing impaired center around processing of the electrical audio signal for improving the listening quality without regard to the acoustic characteristics of the environment. But signal improvements can be negated by poor environment acoustics. The speech enhancing system and method of the present invention for the hearing impaired addresses the simultaneous compensation for room acoustics and particular frequency response characteristics of a hearing impaired system user.

Figure 4:
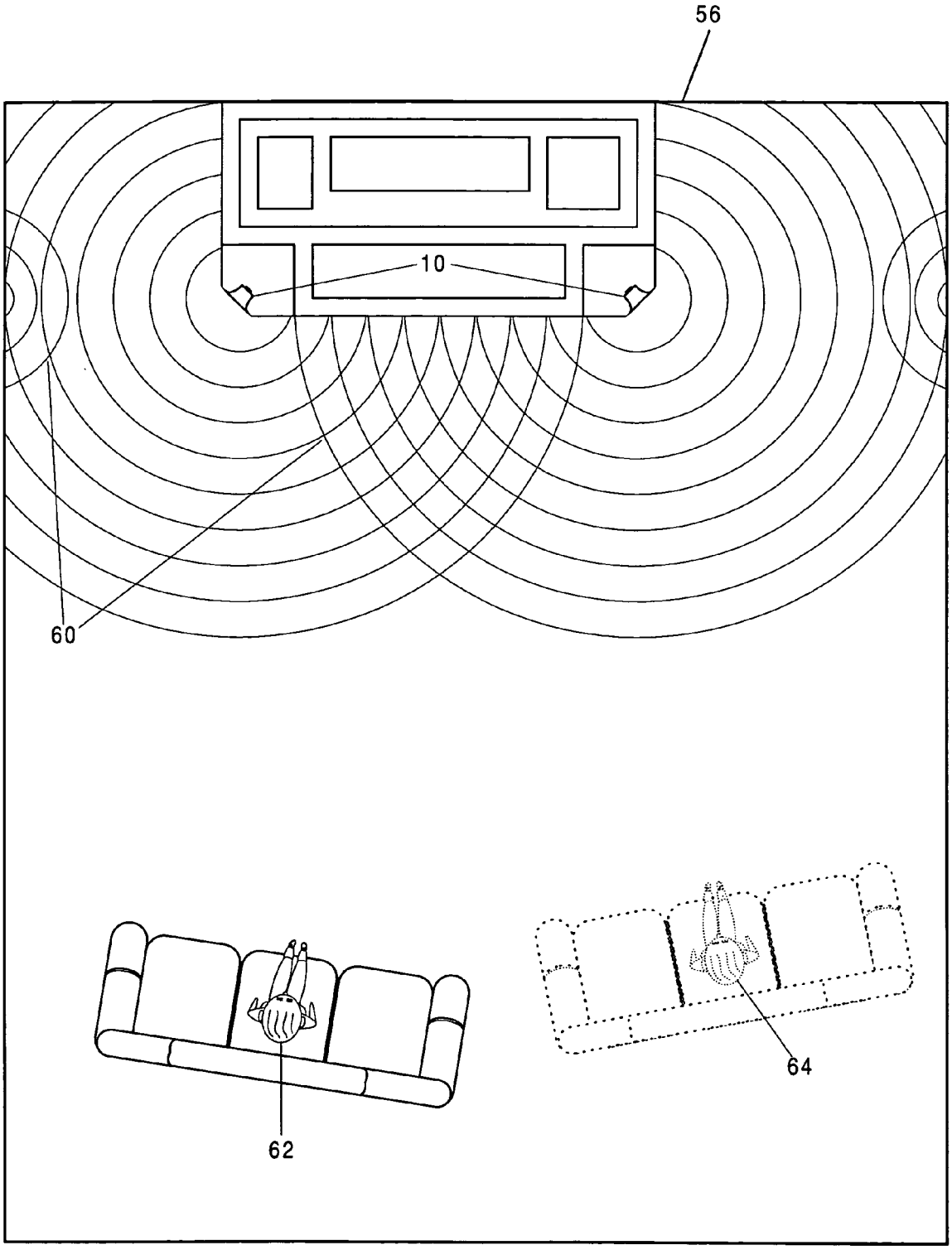
FIG. 4 is a pictorial representation of an environment containing an audio source and a listener, showing the effect of sound wave interference due to reflections of sound waves emanating from the sound source.

FIG. 4 demonstrates a closed room 56 where sound waves, represented by the concentric lines such as 60, are being produced by the speakers 10 in an audio system. The sound waves 60 interact to produce both destructive and constructive interference. Destructive interference attenuates the desired sound level and constructive interference will amplify the sound levels at the interaction points of the waves 60. The patterns demonstrated are two-dimensional but interference created by the interacting waves are a three-dimensional problem. The sound quality degradation due to reflections will have different effects depending on a particular person's listening location 62 or 64.

Figure 5:
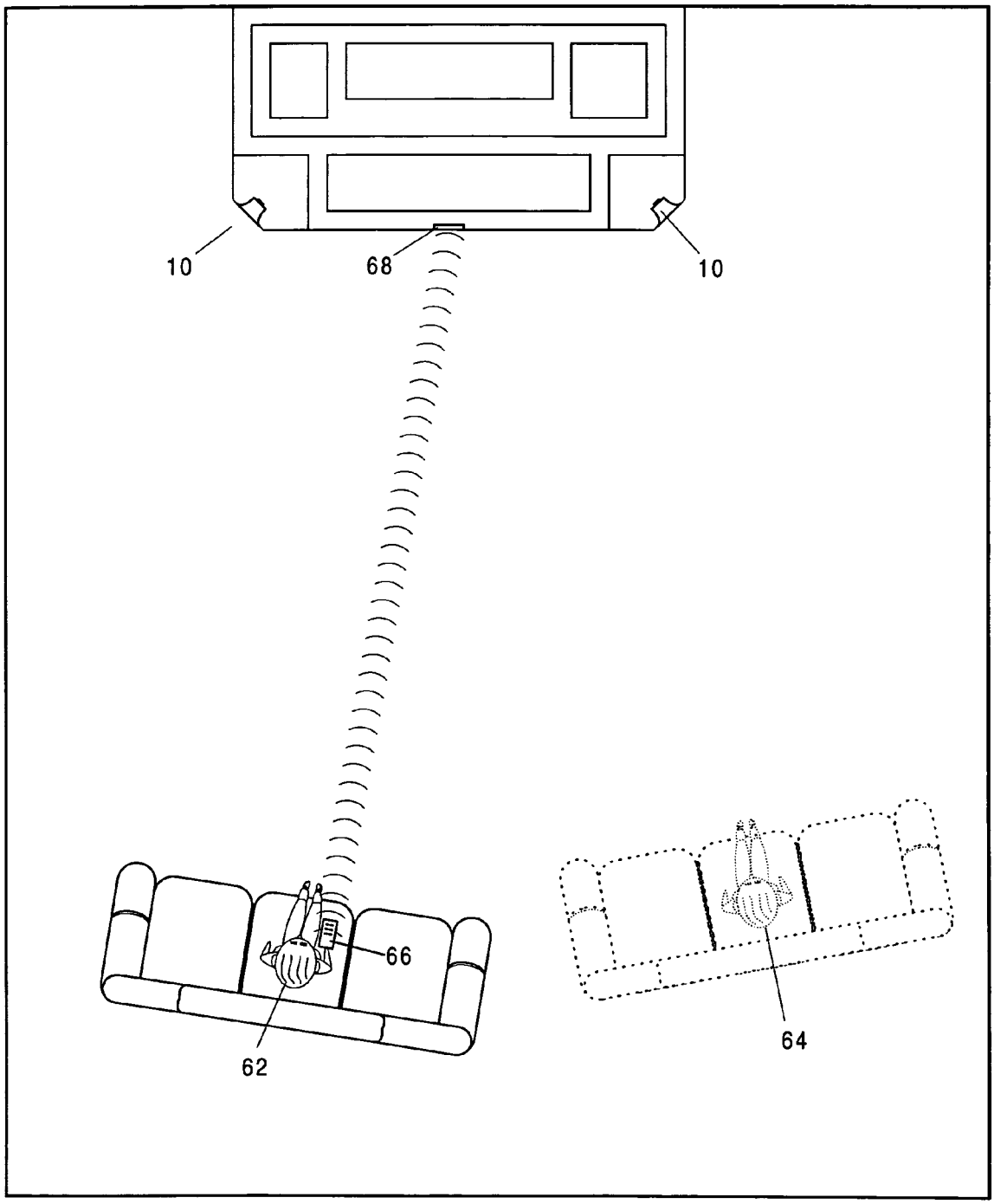
FIG. 5 is a pictorial representation of the environment of FIG. 4 without the representation of the sound wave forms and further showing the use of a remote control unit by a listener in conjunction with and for communicating with the proposed speech enhancement system.

A commonly used technique for equalizing sound levels for a particular listening location 62 is through the use of feedback as seen in FIG. 5. A test signal (normally pink noise) is applied to one speaker 10 at a time, and this signal is input through a microphone to the equalizing electronics 68. The equalizing electronics calculate the sound level power spectrum at the listener's location. With information from the spectral analysis, individual frequency bands can be adjusted until a flat response is attained. For multiple listeners 62 and 64 the adjustment is made to give the best overall response for the listeners. Some compromise must be made because all locations cannot be adjusted for perfect response for all the frequencies of interest. This feature of the present invention is useful for people with normal hearing in addition to the hearing impaired. This procedure is sometimes performed today by skilled audio technicians using a tone generator and real time analyzer (RTA), but some high end home stereo equipment today has the capability of automatically equalizing for the room acoustics. An example of this type of home stereo hardware is the Theater Master series from Enlightened Audio Designs.

Although room acoustics are normally adjusted for a flat response to the listening locations, this is not the desired response for hearing impaired people. Hearing impairments can be well defined by the levels at which an individual can resolve frequencies in the audio band. In the present invention, equalization is used to provide a flat response but also provide a response that amplifies and attenuates the necessary frequencies providing a hearing impaired individual with the proper frequency characteristics to compensate for the hearing impairment. For example, a person with high frequency hearing loss has the upper frequencies boosted for compensation of the impairment.

If persons with normal hearing are present in a room with one or more hearing impaired persons, compensation becomes more difficult. For instance, if high frequencies are boosted for a person in the room with sensorineural hearing loss, listening may become uncomfortable for a person with normal hearing. Headphones may be connected to the present invention for individual compensation. The person with a hearing impairment using the headphones may adjust their audio response to compensate for their particular hearing loss. The other listeners with normal hearing listen to the unmodified audio signal through the speakers. If more than one person with a hearing impairment is to listen to the same audio source, multiple compensation channels and headphone outputs allows for the present invention to individually process the signals for the different types of hearing loss.

The system as seen in FIG. 5 transmits the audio feedback signal to the system processor by using a remote control device 66. The remote control device has a built-in microphone to convert the audio sound waves to an electrical signal that can be transmitted to the hearing impairment system. The electrical audio signal can be transmitted in analog form for use by the system or the analog signal may be converted to digital in the remote control unit and transmitted digitally. Digital transmission has better signal-to-noise characteristics. Remote control devices today are universal allowing a unit to easily be designed incorporating features of the proposed system in addition to the basic functions required for other remotely controlled, consumer audio electronics, such as television, radio, CD player, or the like. Integration of remote functions of the proposed system with existing electronics remote functions allows a single remote to handle all the electronic devices located in a single room.

Figure 6:
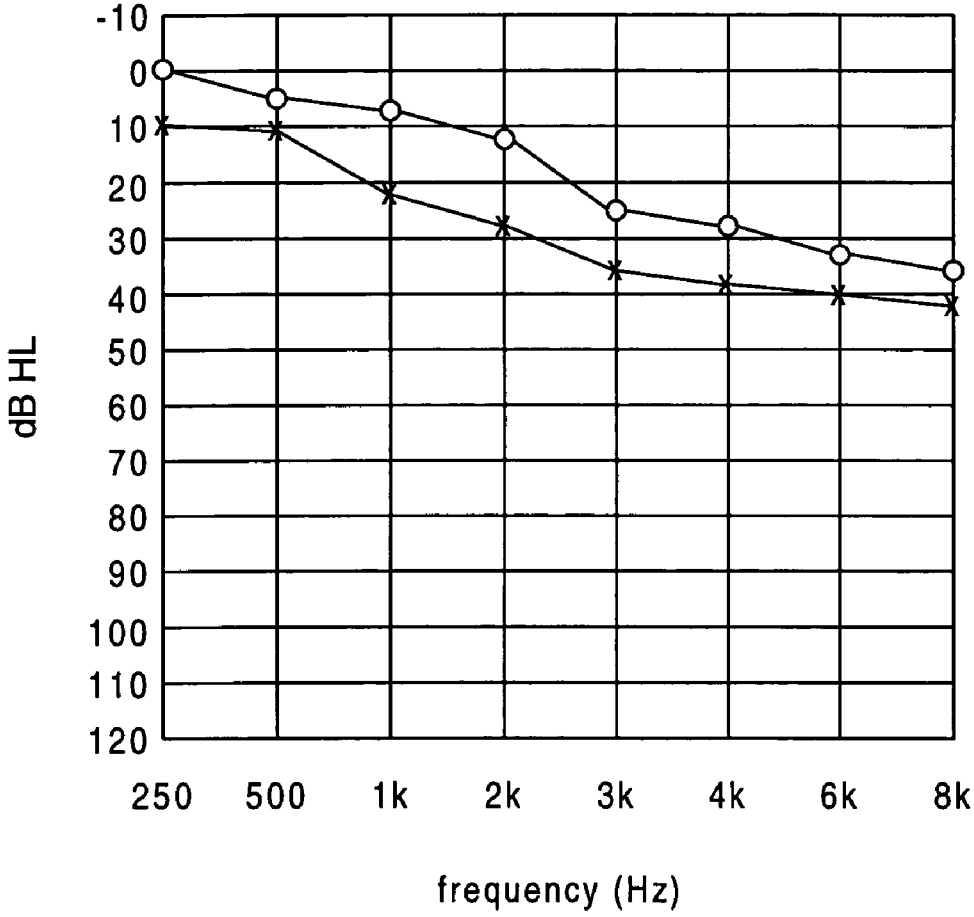
FIG. 6 (Prior Art)
FIG. 6 is an audiogram representation of the results of a hearing test of a hearing impaired person illustrating sensorineural hearing loss.

An audiologist or hearing loss specialist takes measurements of hearing sensitivity for a range of frequencies in the audio range. The results are plotted on an audiogram with an example being shown in FIG. 6. The hearing sensitivity for the right ear is represented with an "o" and the left ear with an "x." The person being tested is presented with pure tones in decreasing amplitudes at the frequencies shown on the independent axis of the audiogram. The amplitudes are decreased until the person being tested notifies the technician administering the test that he or she can no longer hear the tone. The zero reference level is based upon the level at which a normal person can resolve a particular tone 50% of the time. FIG. 6 describes a person with probable sensorineural loss due the decreased sensitivity at higher frequencies.

The present invention has the capability of using the information from the audiogram to provide for compensation of a hearing-impaired person's particular hearing loss. Hearing profile data from a user identifying the response levels from the audiogram may be input manually via a keypad or keyboard with associated display. The display maybe an LCD type, or if the device is connected to a television, the television screen may be used as the display device. Many options are available including but not limited to a personal digital assistants, hand held video cameras, a laptop computer, or the like. The user is prompted to enter the levels for the individual frequencies as derived from the audiogram. When used in conjunction with a television set, the programming of the audiogram information may be accomplished with the remote control unit much the same as setting the time or other programmable features of most modern televisions or VCR's.

In another embodiment, a standard means of encoding the results of the audiogram is established. With a standard encoding technique any audiologist may test a person and have the results stored on any type of digital media such as a floppy disk, flash memory card, CD, or the like. The information may then be entered into the audio enhancement system by simply inserting or loading the disk or media into the system and initiating appropriate loading commands. System software automatically detects that a disk is present and loads the information. The data is labeled so it uniquely identifies the individual, for instance, using the name of the person. If more than one hearing impaired person is to use the equipment, the system is capable of storing audiogram results for many people. Another means of programming the system uses a modem or other type of network connection. The audiologist directly sends the audiogram information to the speech enhancement unit or to a user computer. If sent to the computer, the user may then transfer the information from the home computer or such transfer may be automatically initiated. The Internet may also be used for transfer of the information. The audiologist places the file with the audiogram information at a web site that can be retrieved by a person at home by accessing that particular Internet location.

Figure 7:
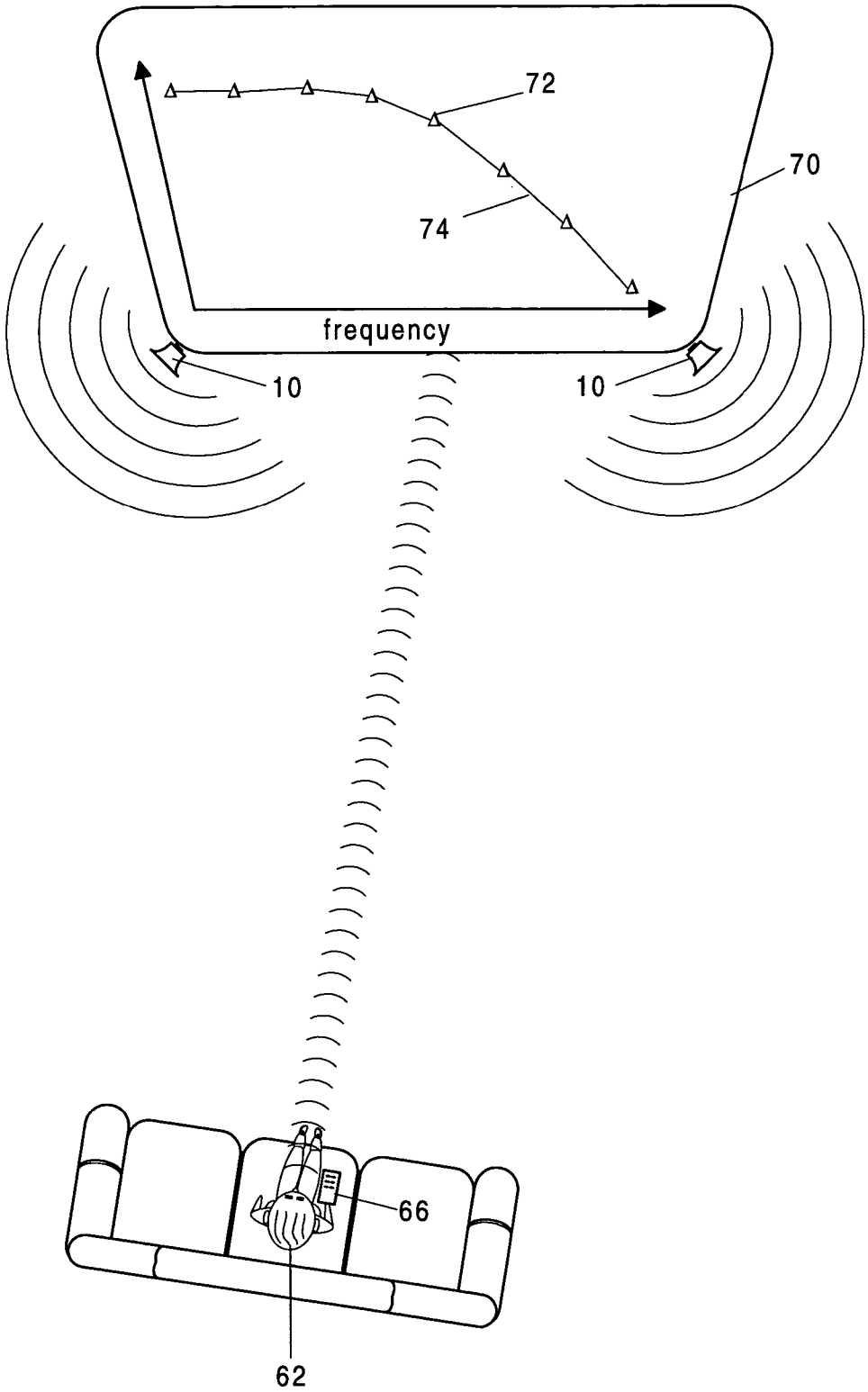
FIG. 7 is a representation of a listener in an environment that is conducting a self-administered hearing test using the proposed speech enhancement system.

If a particular person suspects a hearing impairment and has not been tested by an audiologist, the present speech enhancement system can be used to administer a hearing test. The system provides instructions to a test subject about the test methodology on a display (for instance a television screen) or by synthesized speech if a display is not available. The person being tested uses the remote control to initiate the test and provide responses as the test is carried out. FIG. 7 demonstrates the process of the hearing test. The listener 62 initiates the hearing test from the remote control 66. The system then provides instructions (visual or oral) indicating how the test will be performed. The tested person is instructed to give a certain response when a tone can no longer be heard. Simply pushing a certain button on the remote control unit may indicate the response. A tone is applied to speakers 10 for a given duration. If the expected response from the person being tested is received, the tone is reduced in amplitude by a predetermined amount. At some point the individual will not be able to hear the tone and gives the instructed response on the remote control. A point 72 representing the measured level is displayed on a plot on the screen 70. When the test is completed a curve 74 shows the hearing loss, if any, for the given individual. This information is saved in the system under the tested individual's name for use by the compensation portion of the proposed system.

In severe cases of hearing impairment or total deafness, adjusting room acoustics and processing of the audio signal is not sufficient. Current assistance to people who fall into this category includes the closed captioning system for television. The closed captioning system encodes the text for speech and other important information to be decoded and displayed on the television screen. Closed captioning is accomplished by manually entering text information for the speech involved with a particular program. This process is generally done for each program in advance of broadcast and is very time consuming.

The present invention incorporates speech recognition algorithms to separate spoken words from the rest of the audio signal. Once recognized, the speech is displayed on a television screen (or other display device) in a manner similar to the closed captioning system. The present invention implements speaker independent speech recognition and works with any program in real time, or near real time, not just the programs prepared in advance as those used in current closed captioning systems. Slight delays in program presentation to synchronize recognition operations with visual display may be used to insure high program quality.

Another feature of the speech recognition portion of the present invention allows for converting the digitally recognized speech signals back into audible signals. The synthetic speech can be boosted in amplitude or processed in other ways to make it more intelligible to the hearing impaired person, including compensation for particular hearing loss profiles and environmental acoustical anomalies as described above. Such compensated synthesized speech for the hearing impaired person improves listening capability without having to read the spoken words as text, making for a more relaxed and natural listening experience. If other listeners with normal hearing are present, the hearing impaired person may use headphones attached to the speech enhancement system to provide independent listening of the modified audio signal with synthesized speech. The other listeners hear the unmodified signal (i.e. no synthesized speech) from the usual speaker system.

Figure 9:
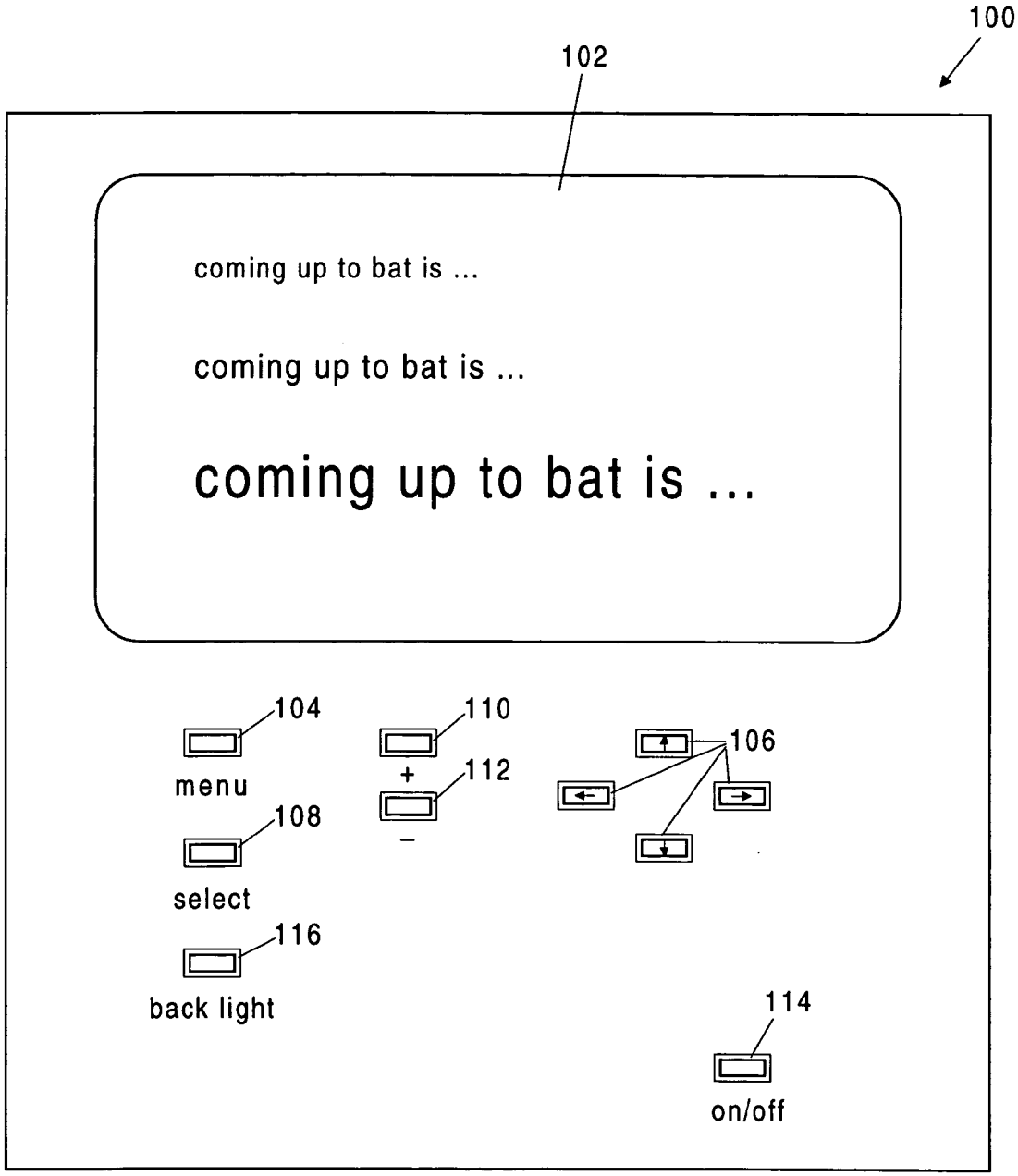
FIG. 9 shows a control/display unit for the speech recognition capability.

The speech recognition system may also be used with other audio sources that produce speech such as the radio. A special display unit receives the radio audio signal, separates the speech, and displays text representing the speech on the unit. Having this capability permits people with severe hearing impairment or total deafness to "listen" to radio based programs such as sporting events that are not televised. FIG. 9 shows a possible hand held display unit 100 for displaying the words generated using the speech recognition capability. The display 102 is constructed using liquid crystal display (LCD) or equivalent technology. As words are determined, they are printed across the display until the end of the line is reached. The last complete word that fits on the line is displayed and the cursor returns to the beginning one line down. The lines of text can scroll upward when the page is finished or the unit can be set to clear and start on a new page.

Information about other environmental audible conditions that are being filtered out or missed by the speech recognition/lip reading functions may also be displayed with the spoken words. For instance, if wind blowing is a distinct part of the current environmental conditions, it would be displayed in some unique way such as in parenthesis. A crowd cheering during a sporting event being displayed gives the "listener" a better feel about the intensity of the particular moment.

The display unit of FIG. 9 can also be used with a camera in conjunction with live performances such as plays, opera, one-on-one conversations, and the like. For example, a deaf person can carry on a "conversation" with another person by aiming a camera at the other person involved in the conversation. The unit implementing speech recognition or lip reading determines the words spoken and displays them on the screen 102. The deaf person can read what was said and responds accordingly. The display unit 100 can also implement the speech enhancement functions for hearing impaired persons as described previously such that it can also be used by persons with less serious hearing deficiencies.

The display unit has push buttons for setting it for individual viewing desires. The unit is menu driven to minimize the button count. Pushing the menu button brings up different functions that can be performed on the display. These functions include, brightness, contrast, font, font size, scroll or page at a time display, setting time, and any other functions appropriate for customizing the display. The arrow buttons 106 allow movement of a cursor through the menus. The select button 108 chooses the desired function to be activated or modified. If the selected function has a range of values, the plus (+) 110 and minus (–) 112 buttons allow for setting the desired value. For example, if a viewer desires a larger font size for the displayed characters, the following steps would be taken. First, the menu button is pushed, bringing up a display of menu options. Next, arrow buttons are depressed until the desired font size is selected. Next, the select button is hit allowing the font size to be increased by depressing the plus (+) button. A power button 114 turns the device on and off. For viewing in dimly lit environments, the display can be back-lit by depressing the back-light button 116.

Figure 10:
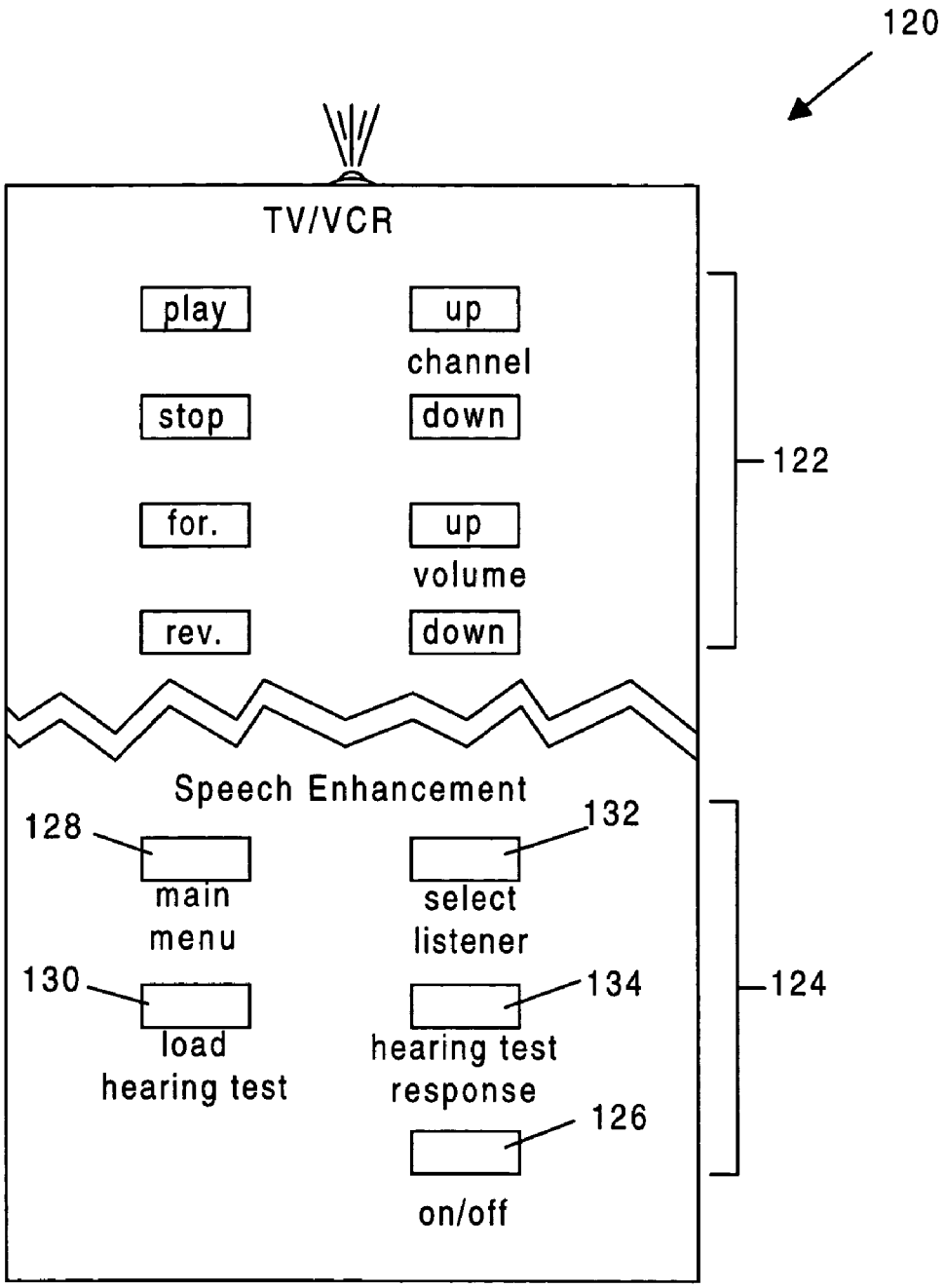
FIG. 10 illustrates a remote menu driven control unit for the speech enhancement unit.

The present invention permits the hearing impaired person to control the operation of the speech enhancement system. The system can be controlled from the front panel of the speech enhancement system 12 or from a remote control device such as those used commonly used to control of televisions, VCR's, and the like. A separate dedicated remote can provide the remote control functions, or the remote functions for the speech enhancement system may be incorporated and functionally integrated into a single remote with a standard consumer electronic device (TV, VCR, etc.). A representative speech enhancement remote control unit 120 is shown in FIG. 10. The upper portion 122 of the remote device 120 contains control buttons for the other electronic devices such as standard television and VCR controls. The lower portion 124 of the remote device has control buttons specific to the speech enhancement system. An on/off button 126 determines if the speech enhancements are activated or bypassed. The main menu button 128 brings up a visible menu (television screen or other visual display unit) with many or all of the functions available to the system. In addition to menu driven options, selected functions may be operated directly from dedicated control buttons on the remote control unit 120, such as the load hearing test 130, select listener 132, and hearing test response 134 illustrated in FIG. 10. Also, the remote control unit can be integrated with a screen to display spoken words in accordance with the teachings of FIG. 9 as discussed above.

In summary one embodiment of the invention is an audio signal processing system for enhancing speech signal intelligibility for the hearing impaired in the presence of system noise, ambient noise, program background noise, and particular hearing impairments. This system includes various components including a speech enhancement system made up of a speech processing unit and a speech signal bypass circuit. It may also include an output signal amplifier and at least one output speaker. The source of an audio signal is connected to the speech enhancement system where one or more options are present. The speech enhancement system either processes the speech signal in the speech processing unit to enhance the intelligibility of the speech signals for the hearing impaired before connection to the output signal amplifier and one or more output speakers. Alternatively, the speech enhancement system bypasses the audio signals directly to the output signal amplifier and one or more speakers. The alternative selections are, in one embodiment, user controlled. More specifically the signal processing system may include remote control and audio/video input signal connected to an input circuit, a central processing unit, an output audio circuit for connection to external amplifiers, an adaptive filter for suppression of system, ambient, and/or interfering background noise present in the input audio signal, and/or for compensating for specific hearing loss parameters for selected hearing impaired listeners, and a hearing test system. An equalization/compensation system may be incorporated into the system to optimize the audio signal for selected room acoustics and hearing impairment profiles of particular users. Likewise, other tools may be incorporated into the system such as a speech recognition system to recognize spoken words, a lip reading computer vision system, a speech synthesis system and even an expert system to assist in the recognition of spoken words based on context. All these elements can be combined in various ways to provide user selected signal enhancement to improve the intelligibility of the audio signal for selected hearing impaired users.

Other nuances may be provided to augment or refine the system. For instance, the adaptive filtering system could include a noise estimator that provides noise estimates to an adaptive filter circuit to provide optimum noise suppression in the output audio signal. The hearing test system, optionally derived based on a locally administered hearing test, may provide control signals, even from a remote source or a user operated remote control unit, to the speech enhancement system to optimize audio signal filter parameters for specific individual hearing impairments. With the use of a screen or monitor spoken words in textual format can be displayed. Another approach is that the output of the speech recognition system, including context appropriateness checking, may be input to the speech synthesis system to generate audible spoken words for the hearing impaired.

Disclosed methods of enhancing speech intelligibility for the hearing impaired, include but are not limited to, providing a central processor having an adaptive filter module including an input section for receiving the audio presentation and an output section for delivering a signal. The audio presentation is filtered to separate the speech from the noise and the speech component is delivered to the central processor. An equalization circuit equalizes for room acoustics for a given listening environment. This equalized speech component is delivered to the central processor that will output the speech component to the output section of the processor for the delivery of the speech for the benefit of the listener.

The inventions set forth above are subject to many modifications and changes without departing from the spirit, scope or essential characteristics thereof. Thus, the embodiments explained above are to be considered in all respect as being illustrative rather than restrictive of the scope of the inventions as defined in the appended claims. For example, the present invention is not limited to the specific embodiments, apparatuses and methods disclosed for frequency compensation of an original audio signal to accommodate the hearing specifics of a particular listener. The present invention is also not limited to the use of only a single improvement methodology but, and will use several of the methodologies at once. The present invention is also not limited to any particular of computer or computer algorithm.

What is claimed is:

1. An audio signal processing system for enhancing speech signal intelligibility for the hearing impaired in the presence of a source of audio signals, system noise, ambient noise, program background noise, and particular hearing impairments, the system including an output signal amplifier, and at least one output speaker, comprising:

a. a speech enhancement system having a speech processing unit and a speech signal bypass circuit, and further including:

remote control and audio/video input signals connected to an input circuit, a central processing unit, an output audio circuit for connection to external amplifiers, an adaptive filter for suppression of system, ambient, and/or interfering background noise present in the input audio signal, and/or for compensating for specific hearing loss parameters for selected hearing impaired listeners, a hearing test system, an equalization/compensation system to optimize the audio signal for selected room acoustics and hearing impairment profiles of particular users, a speech recognition system to recognize spoken words, a lip reading computer vision system, an expert system to assist in the recognition of spoken words based on context, a speech synthesis system, wherein the central processing unit includes switching and control circuits for interconnecting the input circuit audio/visual input signals to the adaptive filter, the equalization/compensation circuit, the hearing test system, the speech recognition system, the lip reading expert system and the output circuits to provide user selected signal enhancement to improve the intelligibility of the audio signal for selected hearing impaired users and further wherein the source of audio signals is connected to the speech enhancement system which either processes the speech signal in the speech processing unit to enhance the intelligibility of the speech signals for the hearing impaired before connection to the output signal amplifier and one or more output speakers, or bypasses the audio signals directly to the output signal amplifier and one or more speakers, the bypass option and speech enhancement processing operations being under user control.

2. The audio signal processing system of claim 1 wherein the adaptive filtering system includes a noise estimator that provides noise estimates to an adaptive filter circuit to provide optimum noise suppression in the output audio signal.

3. The audio signal processing system of claim 1 wherein the hearing test system provides control signals to the speech enhancement system to optimize audio signal filter parameters for specific individual hearing impairments.

4. The audio signal processing system of claim 3 wherein the control signals are input from a remote source.

5. The audio signal processing system of claim 3 wherein at least some of the control signals are derived based on a locally administered hearing tests.

6. The audio signal processing system of claim 1 wherein at least some of the system control signals are input via a user remote control unit.

7. The audio signal processing system of claim 6 wherein the remote control unit includes a screen to display spoken words in textual format.

8. The audio signal processing system of claim 1 wherein the output of the speech recognition system is input to the speech synthesis system to generate audible spoken words for the hearing impaired.

9. The audio signal processing system of claim 1 wherein the expert system is programmed to enhance speech recognition operations based on the context of the spoken words.

10. The method of processing audio signals from a source of audio signals for enhancing speech signal intelligibility for the hearing impaired including a speech processing unit and a speech signal bypass circuit, an output signal amplifier, and at least one output speaker comprising the acts of:

a. connecting remote control and audio/video input signals to an input circuit, b. providing a central processing unit, c. providing an output audio circuit for connection to external amplifiers, d. suppressing system ambient, and interfering background noise present in the input audio signal, and compensating for specific hearing loss parameters for selected hearing impaired listeners using adaptive filtering, e. providing an integrated hearing test system for testing the hearing of users, f. providing an equalization/compensation system to optimize the audio signal for selected room acoustics and hearing impairment profiles of particular users, g. providing a speech recognition system to recognize spoken words, h. providing a lip reading computer vision system, i. providing an expert system to assist in the recognition of spoken words based on context, j. producing audible speech using speech synthesis, k. using the central processing unit switching and control circuits for interconnecting the input circuit audio/visual input signals, to the adaptive filter, the equalization/compensation circuit, the hearing test system, the speech recognition system, the lip reading expert system and the output circuits to provide user selected signal enhancement to improve the intelligibility of the audio signal for selected hearing impaired users, and l. connecting the source of audio signals to the speech enhancement system which either processes the speech signal in the speech processing unit to enhance the intelligibility of the speech signals for the hearing impaired before connection to the output signal amplifier and one or more output speakers, or bypasses the audio signals directly to the output signal amplifier and one or more speakers, the bypass option and speech enhancement operations being under user control.

11. The method of audio signal processing for enhancing speech signal intelligibility for the hearing impaired of claim 10 further comprising the act of using adaptive filtering including a noise estimator that provides noise estimates to an adaptive filter circuit for optimum noise suppression in the output audio signal.

12. The method of audio signal processing for enhancing speech signal intelligibility for the hearing impaired of claim 10 further comprising the act of using hearing tests of users to provide control signals to the speech enhancement system to optimize audio signal filter parameters for specific individual hearing impairments.

13. The method of audio signal processing for enhancing speech signal intelligibility for the hearing impaired of claim 12 wherein the control signals are input from a remote source.

14. The method of audio signal processing for enhancing speech signal intelligibility for the hearing impaired of claim 12 wherein at least some of the control signals are derived based on a locally administered hearing tests.

15. The method of audio signal processing for enhancing speech signal intelligibility for the hearing impaired of claim

10 wherein at least some of the system control signals are input via a user remote control unit.

16. The method of audio signal processing for enhancing speech signal intelligibility for the hearing impaired of claim 15 wherein the act of using a remote control unit includes the use of a screen to display spoken words in textual format.

17. The method of audio signal processing for enhancing speech signal intelligibility for the hearing impaired of claim 10 wherein the act of using the output of the speech recognition system includes the further act of generating input to the speech synthesis system to create audible spoken words for the hearing impaired.

18. The method of audio signal processing for enhancing speech signal intelligibility for the hearing impaired of claim 10 wherein the act of using the expert system includes programming the system to enhance speech recognition operations based on the context of the spoken words.

* * * * *